United States Patent [19]

Daugiras et al.

[11] 4,231,192

[45] Nov. 4, 1980

[54] LINEAR OUTPUT FORCE DOOR OPERATOR

[75] Inventors: Kristupas Daugiras, Wilmette; Samir M. Elguindy, Roselle, both of Ill.

[73] Assignee: Vapor Corporation, Chicago, Ill.

[21] Appl. No.: 2,887

[22] Filed: Jan. 12, 1979

Related U.S. Application Data

[63] Continuation-in-part of Ser. No. 794,842, May 9, 1977, Pat. No. 4,134,231.

[51] Int. Cl.[3] ..... E05F 11/12

[52] U.S. Cl. ..... 49/363

[58] Field of Search ..... 310/184; 49/360, 363

[56] References Cited

U.S. PATENT DOCUMENTS

| | | | |
|---|---|---|---|
| 965,770 | 7/1910 | Voight | 49/363 |
| 2,807,736 | 9/1957 | Jensen | 310/184 |
| 3,453,778 | 7/1969 | Daugirdas | 49/463 X |

*Primary Examiner*—Kenneth Downey

*Attorney, Agent, or Firm*—Francis J. Lidd

[57] ABSTRACT

A door operator including a unique electrical drive motor and a linkage arrangement having a drive bar applying driving action through a roller to a slide bar multiplying level wherein the multiplying lever is pivotally mounted at one end and slidably engaging a roller near the other end which is mounted on a slidable door.

21 Claims, 15 Drawing Figures

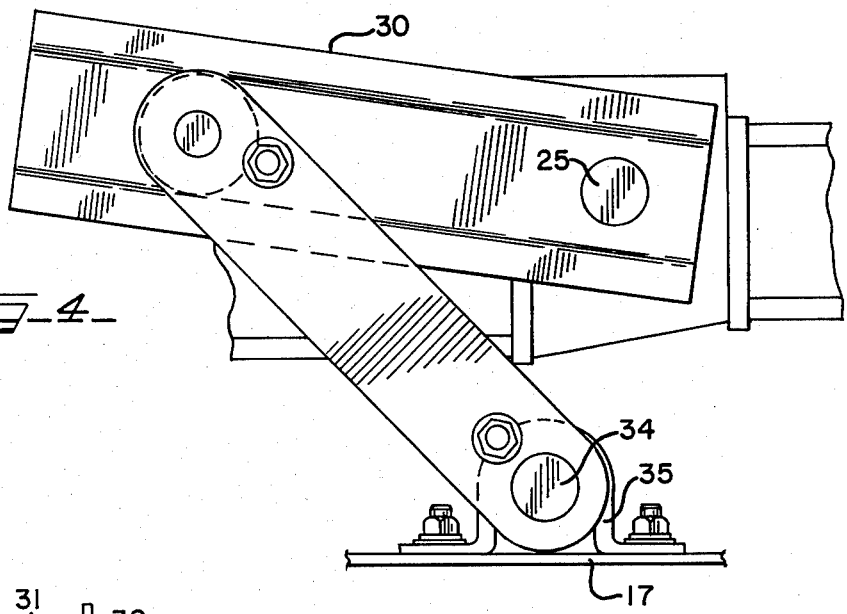
FIG. 4
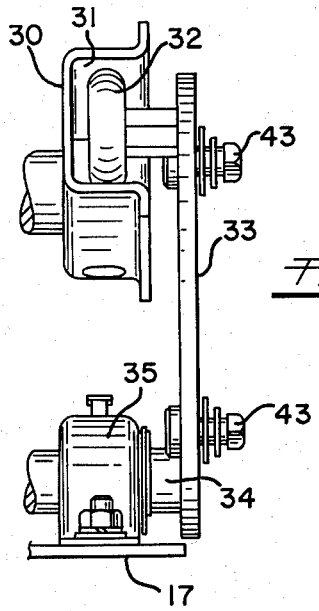
FIG. 5
FIG. 6
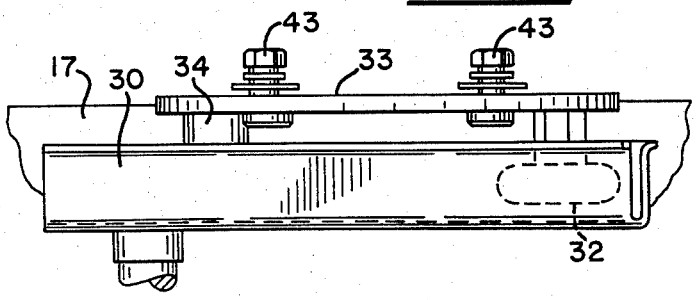

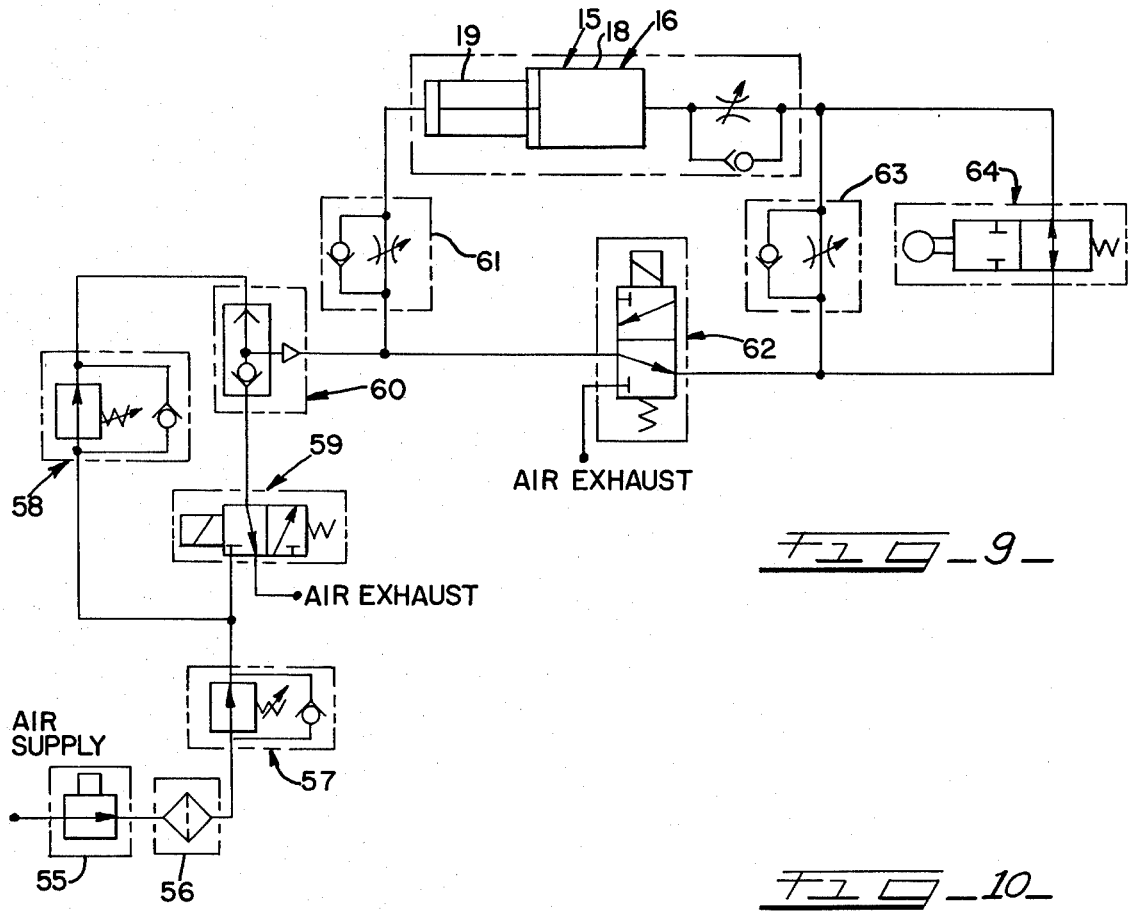
FIG. 9
FIG. 10
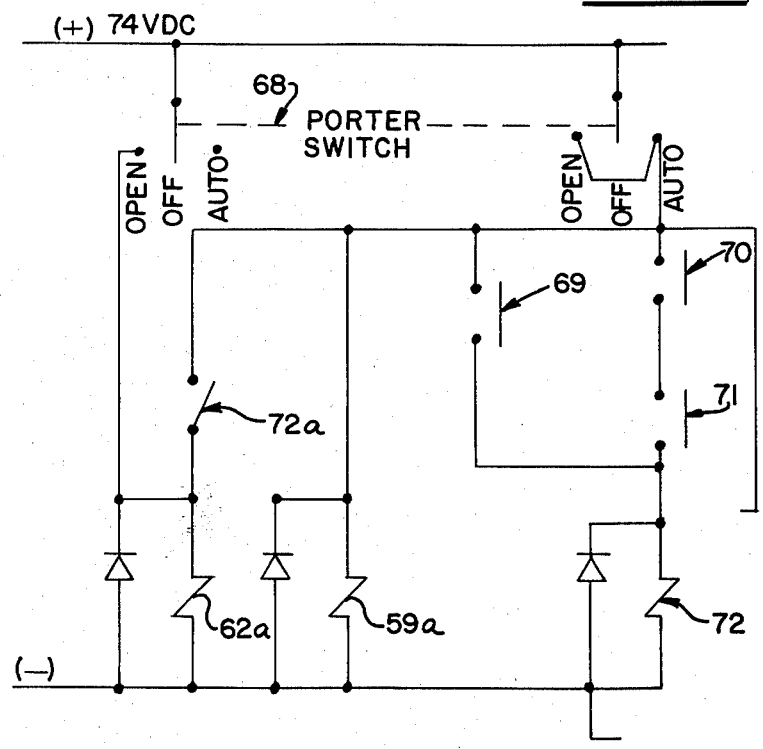

LINEAR OUTPUT FORCE DOOR OPERATOR

This application is a continuation-in-part of our copending application Ser. No. 794,842, filed May 9, 1977 now U.S. Pat. No. 4,134,231.

This invention relates in general to an apparatus for driving doors between open and closed positions in a vehicle or a building, and more particularly to a door operator capable of producing a substantially linear static output force along essentially the entire door travel.

The present invention is particularly concerned with the operation of doors on railroad passenger cars, and particularly sliding doors arranged between interconnected passenger cars to provide automatic door operation for passenger traffic between the cars. It is therefore important to safeguard passengers using such doors against injury. Such door operators are preferably passenger actuated for opening and automatically actuated for closing although totally automatic operation initiated at a remote location is also contemplated. Further, such operators must have provisions for sensing an obstruction to prevent injury of a passenger that may be in the path of a closing door.

The door operator of the present invention utilizes a unique series wound motor and a unique linkage arrangement. Door operators heretofore known using series wound motors and conventional four bar linkages are objectionable under present day standards in that they produce an unacceptable closing buildup or stall force near the end of the closing cycle when the door edge approaches its complimentary closure member. These forces, as will be shown, are appreciable and can be injurious or can "trap" an appendage of a passenger's body or clothing. Likewise, the stall force at the beginning of the closing cycle is at a high level. The present invention eliminates this buildup and provides a substantially linear stall force to the door during nearly the entire closing cycle.

An additional problem encountered in power door design involves the need for a drive motor having dynamic characteristics which produce door operation in a predetermined time without excessive velocity and force peaks. Ordinary design methods do not sufficiently consider inertial factors of motor components in concert with driven loads and linkages, resulting in inefficient, oversized units.

It is therefore an object of the present invention to provide a new and improved door operator using a series wound motor for driving doors between open and closed positions and particularly where the doors are utilized for handling passenger traffic.

A further object of this invention is in the provision of a door operator utilizing a unique series wound electric motor together with an improved linkage arrangement for applying a substantially linear force to a door during the closing cycle.

A further object of the invention is in the provision of a door operator especially useful for handling doors through which passenger traffic is provided and which includes a unique series wound motor.

Other objects, features and advantages of the invention will be apparent from the following detailed disclosure, taken in conjunction with the accompanying sheets of drawings, wherein like reference numerals refer to like parts, in which:

FIG. 4 is an enlarged side elevational view of a part of the door operator of FIG. 1 and particularly illustrating the output linkage arrangement which produces a modulated output force to a door;

FIG. 5 is an end elevational view of the output linkage shown in FIG. 4;

FIG. 6 is a top plan view of the output linkage shown in FIG. 4;

FIG. 9 is a schematic diagram of the pneumatic circuit for the door operator of FIG. 1 and illustrating the state of the circuit when the door is in closed position;

FIG. 10 is an electrical schematic diagram of the circuit for the door operator of FIG. 1 and illustrating the state of the circuit when the door is in closed position and when the porter switch is in off position;

One embodiment of the invention is especially useful for railway transit cars which transport passengers and which have passenger doors between connecting cars that are normally maintained closed and which are desired to be opened by passengers during movement between cars. Accordingly, the door operator of the invention may be actuated by a passenger to drive it throughout the opening cycle. Alternately, the door operator may be controlled by the porter to open the door and maintain it in open position or to maintain the door in closed position. When the operator is set for passenger operation, it is only necessary for a passenger to actuate a switch to cause the door to open after which the door operator goes through the door opening cycle. Where the door operator is one having a pneumatic differential engine, an electropneumatic control circuit controls the engine through opening and closing cycles. Once the door engine completes the opening cycle, it will automatically go through a closing cycle upon the lapse of a predetermined delay. In the event an obstruction is sensed at the door edge during the closing cycle, the operator will recycle through the opening cycle. In the event of electrical failure, the differential engine is conditioned with a lower pneumatic force level which permits manual opening of the door. A modulated output force is provided with this pneumatic engine operator. Where the door operator is one having the unique series wound motor of the invention and the unique linkage arrangement, a substantially linear output force is obtained.

Figure 1:
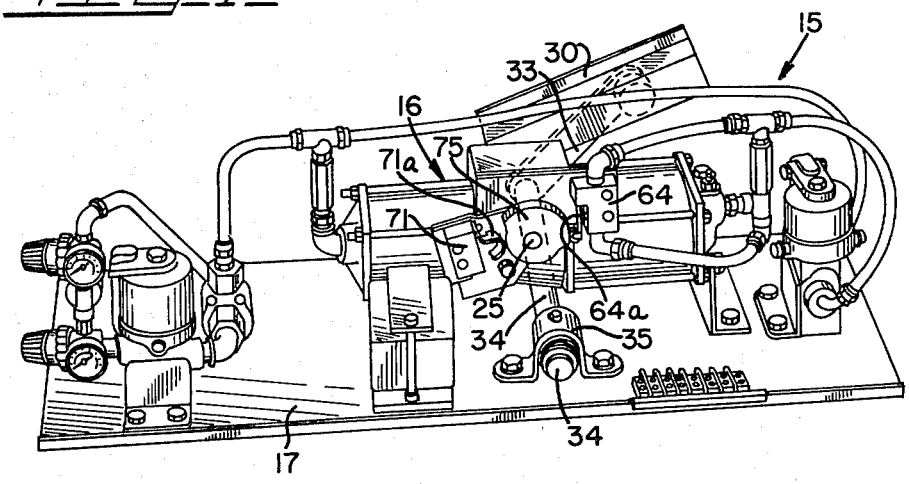
FIG. 1 is a perspective view of one form of door operator according to the present invention.

The door operator unit illustrated in FIG. 1 and generally designated by the numeral 15 includes a pneumatic differential engine 16 mounted on a base plate 17. The engine is of the general type shown in U.S. Pat. Nos. 1,557,684 and 1,849,516 and includes a housing having interconnected large and small cylinders 18 and 19 receiving large and small pistons 20 and 21 respectively, wherein the pistons are interconnected by a rod 22 having a rack gear 23 in engagement with a pinion gear 24 mounted on an output shaft 25. The cylinders 18 and 19 and the respective pistons are characterized large and small for differentiation and the significance here is that they are of different sizes. The housing for the cylinders is supported on suitable brackets 26 and 27 that are secured to the base plate 17.

Figure 2:
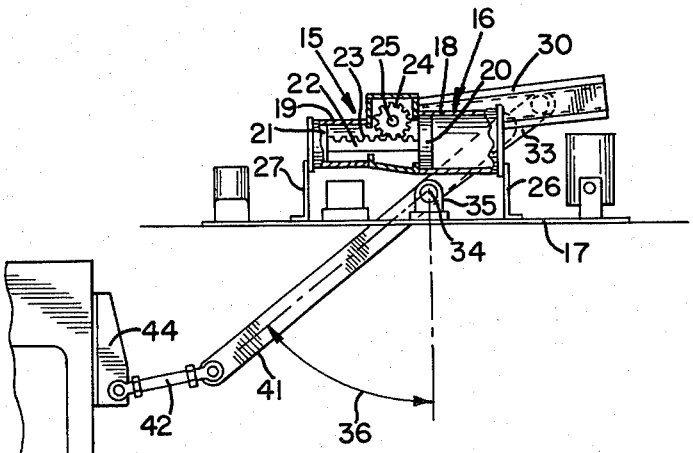
FIG. 2 is a somewhat diagrammatic view of the door operator of FIG. 1 mounted overhead and interconnected with a door.
Figure 3:
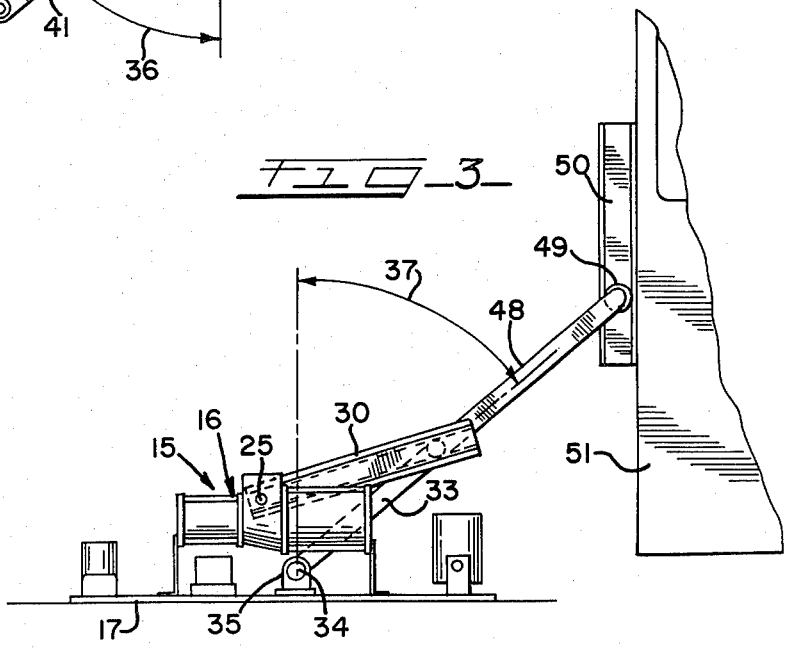
FIG. 3 is a somewhat diagrammatic view of the door operator of FIG. 1 mounted on a floor and drivingly connected to a door.

A slide bar 30 is connected at one end to the output shaft 25 and defines a track 31 for receiving a roller 32 mounted on the end of a multiplying lever 33. The other end of the multiplying lever is secured to a shaft 34 rotatably mounted in bearings 35 secured to the base plate 17. The axis of the shaft 34 is parallel to the axis of the engine output shaft 25. Further, the shaft 34 is located beneath the shaft 25. During the opening cycle of the engine 16, the output shaft 25 rotates through an arc to drive the slide bar 30 upward and to the left, as shown in FIGS. 2 and 3. All of the necessary supporting components for controlling the operation of the engine 16 are preferably supported on the base plate 17.

The modulated output force generated by the engine 16, slide bar 30 and multiplying lever 33 and applied to the door is accomplished by the interrelationship between the rotation of the output shaft 25 and slide bar 30, the lengths of the slide bar and the multiplying lever and the relative rotations of the output shaft and the multiplying lever. This relationship is such that rotation of the slide bar about 180 degrees during the opening and closing cycles will produce about an 80 degree rotation of the multiplying lever. As viewed in FIGS. 2 and 3, rotation of the slide bar about 90 degrees effects about a 40 degree rotation of the multiplying lever to the mid travel point of the opening or closing cycle as generally represented by the angle 36 in FIG. 2 and the angle 37 in FIG. 3. The angles represented are equivalent to movement of the door to mid travel point during the opening cycle, and it can be appreciated that further rotation of the slide bar another nearly 90 degrees will further effect rotation of the multiplying lever about another 40 degrees. Accordingly, a modulated force output is generated by the engine through the slide bar and the multiplying lever arrangement as represented by the graphical illustrations of FIGS. 7 and 8.

An illustration of how the operator 15 can be mounted overhead at the ceiling is shown in FIG. 2, while an illustration of how it can be mounted on the floor is shown in FIG. 3. With respect to both of these embodiments, the multiplying lever 33 will move through an arc of substantially the same extent during the opening and closing cycles of the engine.

The embodiment of FIG. 2 where the operator is mounted at the ceiling is interconnected with a door 40 through pivotally interconnected links or arms 41 and 42. The arm 41 which is an extension of the multiplying lever 33 is connected to the lever 33 by means of a pair of connecting bolts or fasteners 43. The arm 41 is therefore connected at one end to the multiplying lever 33 and at the other end of a connecting link or arm 42, the latter of which is in turn pivotally connected to a bracket 44 secured to one edge of the door 40. Accordingly, opening and closing forces produced by the differential engine 16 are transmitted through the slide bar 30 and multiplying lever 33 to the arms 41 and 42 and finally the door 40.

Where the door operator is mounted on the floor, as shown in FIG. 3, the engine is connected through the slide bar and multiplying lever to the door by means of a roller arm 48 having a roller 49 at the free end engageable in a track 50 secured to the edge of the door 51. During operation of either of the embodiments of FIGS. 2 and 3, the slide bar 30 traverses through a greater angle than the driven multiplying lever 33 or the extension arms 41 and 48. By virtue of the fasteners 43 mounted on the multiplying lever 33, the installation of a door operator of the invention and the connections between the multiplying lever and the door are relatively easy and can be accomplished quickly. Further, the door operator is universal to the extent that it can also then be used either as a unit mounted at the ceiling or a unit mounted at the floor and for a left-hand or a right-hand installation.

Figure 7:
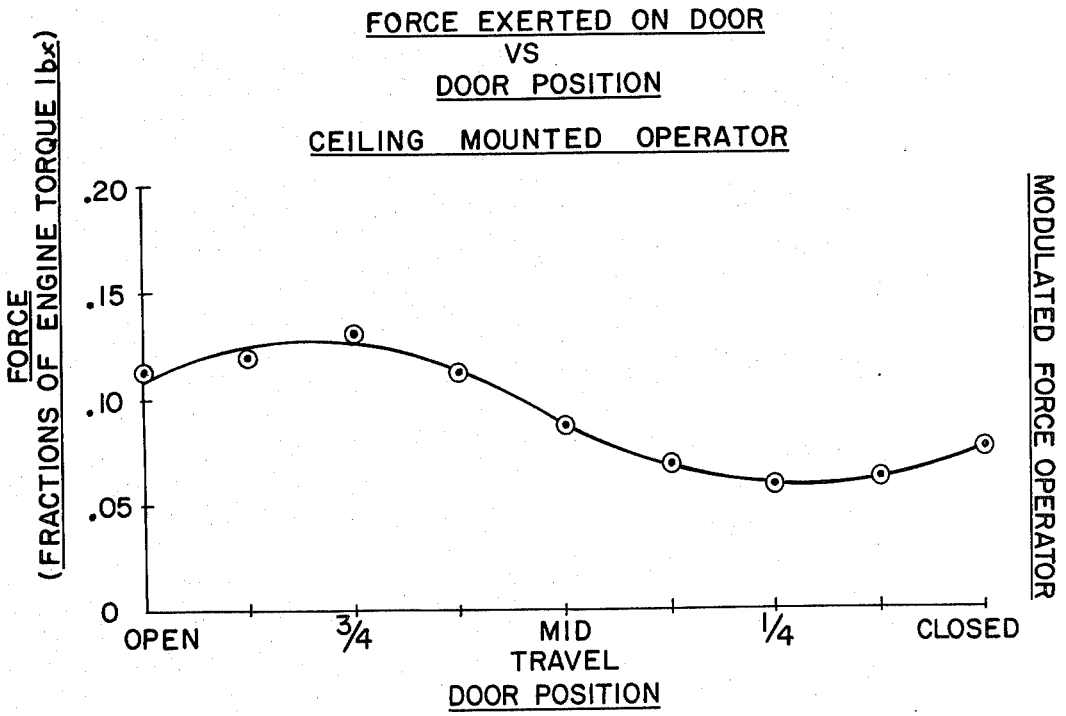
FIG. 7 is a force diagram of the door operator of FIG. 1 and particularly the embodiment of FIG. 2.
Figure 8:
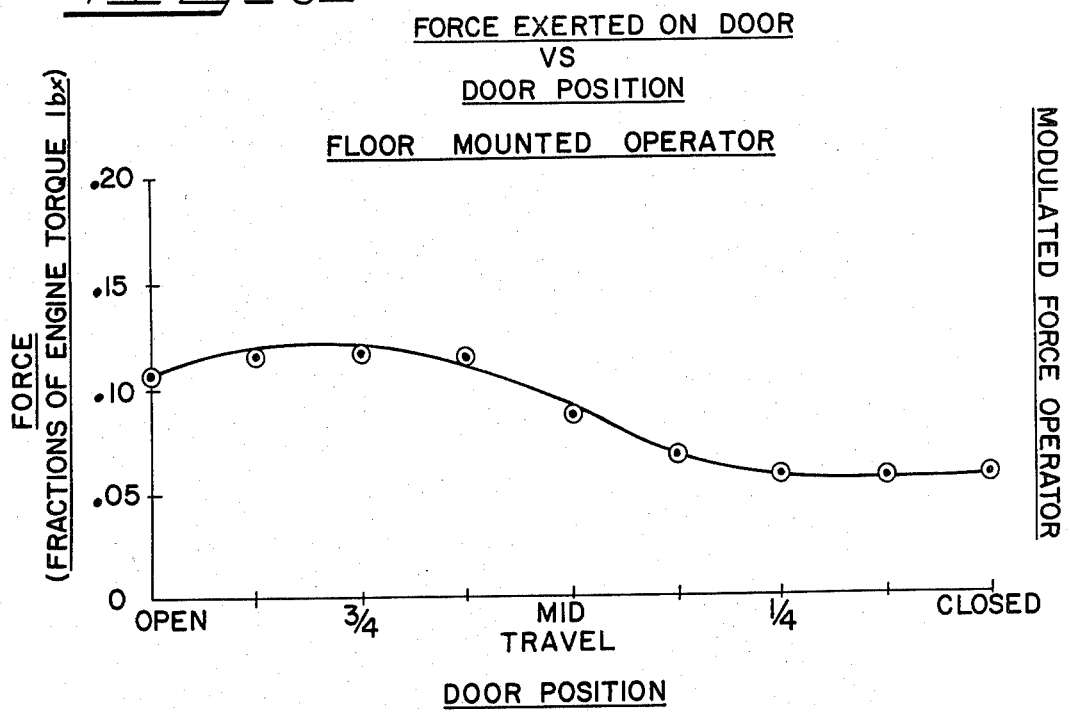
FIG. 8 is a force diagram of the door operator of FIG. 1 and particularly the embodiment of FIG. 3.

The modulated force applied to the door by the door operator of FIG. 1 is graphically illustrated in FIGS. 7 and 8. The illustration of FIG. 7 relates to a ceiling mounted operator such as shown in FIG. 2, while the illustration of FIG. 8 relates to a floor mounted operator, as shown in FIG. 3. It can be appreciated from these graphical illustrations that the modulated force produced by the operator is relatively constant throughout the travel of the door during the closing cycle and that the force drops off slightly between the mid point of the closing cycle and the fully closed position.

The pneumatic circuit for the differential engine 16 is illustrated in FIG. 9 and generally includes an air supply to an air cock 55, an air strainer 56, an adjustable high pressure regulator 57, an adjustable low pressure regulator 58, a three-way normally closed magnet valve 59, a shuttle valve 60, an adjustable door closing metering valve or flow control valve 61, a door open three-way normally open magnet valve 62, an adjustable door opening cushioning metering valve or flow control valve 63, and a cam operated air valve 64. The components of the circuit as illustrated are in the condition when the door is in closed position.

The electrical control circuit for the door operator of FIG. 1 is shown in FIG. 10 and includes generally a porter switch 68 operable between off, open and automatic positions, a passenger switch 69 of the momentary push type for effecting the opening cycle, a sensitive edge switch 70 which may be mounted along the edge of the door and which would sense an obstruction and which would function, when actuated, to recycle the door operator through the opening cycle, a cam operated limit switch 71 which opens and prevents operation of the sensitive edge switch when the door is in closed position, and a time delay relay 72 which functions to maintain the door in open position through a predetermined period of time and thereafter to condition the circuit for the closing cycle. The time delay relay 72 includes contacts **72*a*. Further, the magnet portion of the three-way magnet valves 59 and 62 are illustrated as 59***a* and 62*a*. It will be understood that the limit switch 71 opens just ahead of the closed position or just prior to the door reaching closed position. Likewise, it will close during the opening cycle just after the door leaves the closed position to render effective the sensitive edge switch circuit.

The operation of the door operator electropneumatic control circuit during the opening and closing cycles further depends upon the mechanical actuation of the cam operated air switch 64 and the cam operated limit switch 71. As seen in FIG. 1, a cam 75 is mounted on the output shaft 25 of the engine 16 and which engages and operates the actuating arm 64*a* of the cam operated switch 64 and the actuating arm 71*a* of the limit switch 71. As illustrated in FIG. 1, the cam is positioned with the door in closed position and which conditions the cam operated air switch 64, as shown in FIG. 9, and the cam operated limit switch 71, as shown in FIG. 10. Shortly after the engine commences the opening cycle, the cam operated air switch 64 is closed and the cam operated limit switch 71 is closed.

With the porter switch 68 in the automatic position and upon actuation of the passenger switch 69 by a passenger, closing of switch 69 causes engergization of the time delay relay 72 to close the contact 72*a* and thereby energize the door open magnet valve 62. The time delay for the time delay relay 72 starts when the relay is de-energized upon opening of the passenger switch 69 and is set to hold the contact 72*a* in closed position and the magnet valve 62 to exhaust for about 15 seconds or a suitable period of time so that the passenger can complete movement through the doorway. While the door open magnet valve 62 is energized, the air from the large cylinder 18 is exhausted. Initially, the cam operated valve 64 is open to allow an initial unregulated flow of air to exhaust to begin opening of the door. Following this quick burst of air, the valve 64 closes by operation of cam 75, whereby the exhaust air from the large cylinder must then pass through the parallel circuit having the flow control valve 63 which cushions the door opening cycle.

When the door reaches the fully open position, and at the expiration of the time delay set up by the time delay relay 72, the time delay relay drops out and de-energizes the door open magnet valve 62 to once again connect the large cylinder to the high pressure regulated source and cause closing of the door. Both the air directed to the large cylinder and the air then exhausted from the small cylinder 19 is regulated to provide a door closing cushion. The door closing cushioning valve 61 regulates the exhausting of the air from the small cylinder 19.

During the closing cycle, it will be appreciated the limit switch 71 will be closed, thereby conditioning the sensitive edge circuit so that upon actuation the sensitive edge switch 70 will cause energization of the time delay relay 72 and consequent energization of the door opening magnet valve 62 to cause the door engine to go through an opening cycle. Thus, an obstruction at the edge of the door during the closing cycle will cause actuation of the sensitive edge switch 70 and a recycling of the door open cycle.

By actuation of the porter switch 68 to the open position, the time delay relay contacts 72 are bypassed and the door open magnet valve 62 is energized to cause the operator to effect the opening cycle and maintain the door in an open position. Thus, the doors will then remain in the open position until the porter switch is actuated to either the off or automatic positions.

It will be appreciated that when the porter switch is in either the open or automatic position, the high pressure magnet valve 59 is energized to connect the high pressure from the high pressure regulator 57 to the shuttle valve 60. In the event the electrical power fails at this time, the high pressure magnet valve 59 will de-energize, thereby shutting off the high pressure regulator to the shut-off valve and exhausting the system of the high pressure level. Air from the high pressure valve is then channeled through the parallel circuit which includes the low pressure regulator 58 which delivers the low pressure through the shuttle valve to the system. This low pressure allows the doors to be opened and closed manually. The air pressure at this point is sufficient so that it will maintain the doors in a closed position when desired. Actually, the door once opened manually will automatically close slowly due to the differential force between the large and small cylinders of the differential engine. This effectively defines a pneumatic spring effect to the door and eliminates the need to provide any mechanical spring for maintaining the door in closed position.

The door operator embodiment of FIGS. 11 to 15 is a modification which differs from the above described embodiment in that it is electrically driven and includes a linkage arrangement with an overcenter lock. The linkage arrangement is similar to that of the previous embodiments in that a drive arm mounted on the output shaft of the operator applies force to a multiplying lever connected to the door being driven by the operator. The unique series wound electric motor coupled with a gear box having a given gear ratio drives a unique linkage arrangement to provide a substantially linear door edge force along essentially all of the door travel between open and closed positions and, more particularly, to provide a relatively low door closing force just before final closing position.

Figure 11:
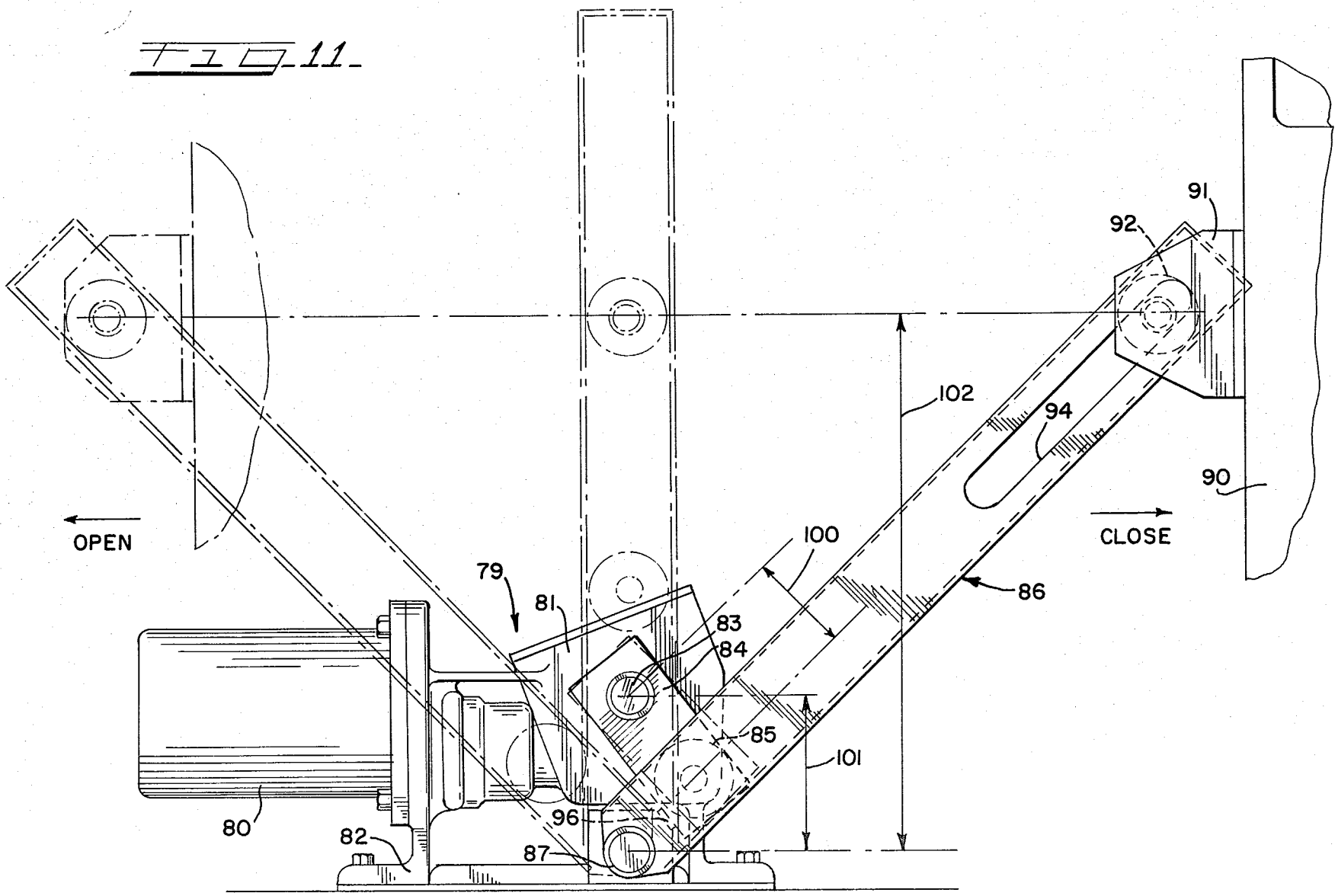
FIG. 11 is a side elevational view of a modified door operator of the invention illustrating the operator and door in solid in closed position and in phantom in mid-travel and open positions.
Figure 12:
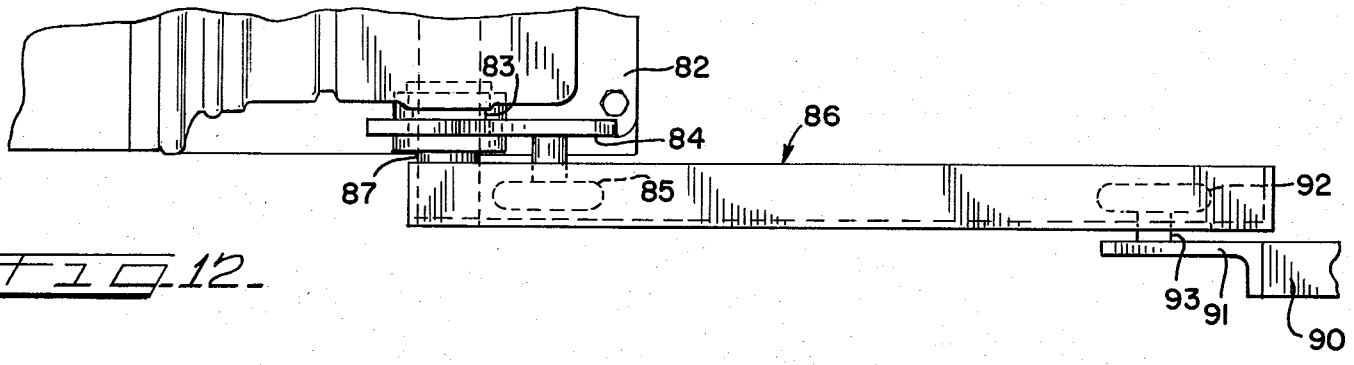
FIG. 12 is a top plan view of the door operator illustrated in FIG. 11 showing the operator and door in closed position.
Figure 13:
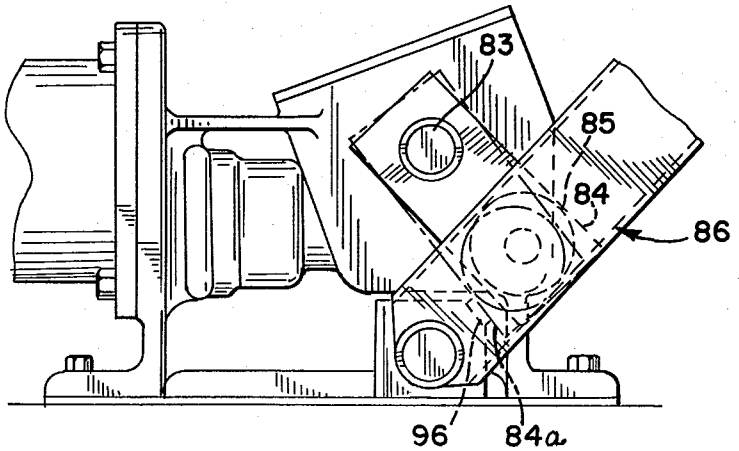
FIG. 13 is a side elevational partly fragmentary view of the door operator of FIG. 11 showing the operator in closed but unlocked position in solid lines and in closed and locked position in phantom.

Referring to the door operator in FIGS. 11, 12 and 13, the operator includes an electric motor 80 generally known to those skilled in the art as "series", although other motor designs such as "compound" and permanent magnet could be utilized, having its output shaft connected into a gear box 81, all of which is mounted on a base 82. The gear box 81 includes an output shaft 83 on which is mounted for oscillation therewith a drive bar 84. A roller 85 is mounted adjacent the free end of the drive bar 84 and slidably engages in a slide bar or multiplying lever 86. The element 86 may be considered a multiplying lever in the form of a slide bar and is connected at one end to a shaft 87 which is pivotally mounted to the base 82. Thus, the slide bar 86 is pivotally mounted at one end to the base of the door operator. The pivot axis of shaft 87 is directly below and parallel to the rotating axis of the output drive shaft 83. In fact, the axes of the drive shaft and slide bar pivot are in superposed relation and generally aligned along a vertical plane relating to the horizontal axis of the door operator.

The door operator 79 is drivingly connected to a door 90 through the slide bar multiplying lever 86. A bracket 91 is fixed to the edge of the door 90 and has mounted thereon a roller 92 which is slidably engaged by the slide bar 86. The roller 92 is carried on a shaft 93 extending from the bracket 91 and the shaft 93 freely extends through a slot 94 formed in the slide bar 86. The side of the slide bar facing the drive arm or drive bar 84 is open. It can be generally appreciated that oscillation of the drive arm 84 causes swinging movement of the multiplying lever 86 and consequently movement of the door 90.

An overcenter locking feature is provided on the door operator, the operation of which can be readily appreciated by reference to FIGS. 11 and 13. The parts of the door operator in FIG. 11 shown in solid lines are in the position where the door 90 is closed and locked. Thus, the overcenter locking feature is in operation in FIG. 11, and in this position the drive bar bears against a stop 96 carried on the base 82. Thus, the drive arm 84 is in the overcenter locked position as shown in solid lines in FIG. 11. The position of the slide bar 86 shown in FIG. 13 in solid lines is such that the door is in closed position. Likewise, the position of the drive arm 84 shown in solid lines in FIG. 13 is such as to cause the slide bar 86 to be positioned as shown where the door is in closed position. The position of the drive arm 84 as illustrated in phantom and designated 84*a* in FIG. 13 is such that the operator is in overcenter locked position. Between the position 84*a* and the position shown in solid lines the door does not move, nor does the slide bar 86 move when the drive arm travels this distance. Thus, the position of the drive arm shown in solid lines presents the door operator in an unlocked condition, while in phantom presents the door operator in locked position. The drive arm must move past the center line between the output shaft 83 and the roller 85 which is perpendicular to the slide bar 86. So when the drive arm rests against the stop 96, the operator is in closed and locked position and the door is closed and locked.

While overcenter locking features on door operators are not new, as illustrated in U.S. Pat. No. 3,537,403, heretofore known operators with overcenter locking features have produced large closing forces which, as indicated earlier, are undesirable due to the possibility of injuring or trapping passengers. The operator of the present invention overcomes these large closure forces. An actual comparison of the door closing forces for the present invention and those of a prior art operator are illustrated in FIG. 14 and will be more particularly referred to hereafter.

Figure 15:
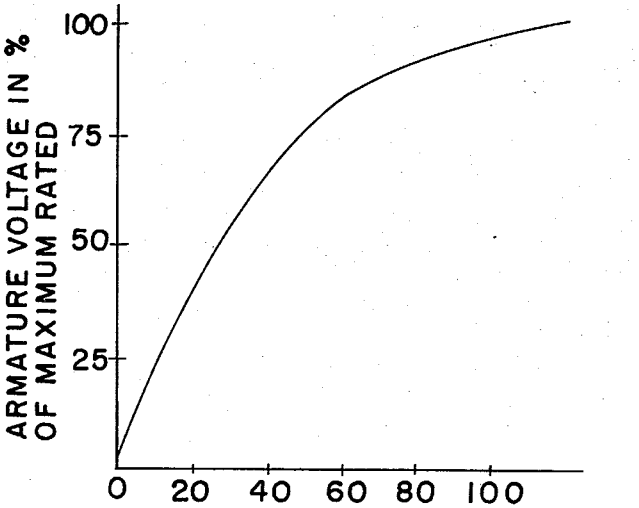
FIG. 15 is an open circuit saturation curve for the unique series wound motor of the embodiment of FIG. 11 which powers the operator.

In the preferred embodiment of the invention, a door operator designed to drive an eighty-pound door includes a unique series wound motor with a gear box having a particular gear ratio and a linkage arrangement having particular measurements. Other door weights are contemplated, generally in a range of fifty to 120 pounds. One particular series wound motor providing forces disclosed and operating in a specified predetermined time of about two seconds would have ten windings on an armature of 24-gauge wire and 40–80 windings on a field of 26-gauge wire. Another preferred motor would have fifteen windings of 24-gauge wire on the armature and 55–65 windings of 26-gauge wire on the field. A preferred gear ratio range of 20 to 25:1 for the gear box 81 would be coupled with the series wound motor and most preferably the gear ratio would be 25:1 reduction. The preferred series wound motor would have an open circuit saturation curve, which will be recognized by those skilled in the art as providing primary identification of motor characteristics, as illustrated in FIG. 15, where field current in percent of maximum rated is plotted against armature voltage in percent of maximum rated. It can be seen by the curve that at approximately fifty percent of maximum rated voltage, the field current will be about forty percent of maximum rated; and with a voltage of approximately eight-five percent of total, the field current will be about eighty percent.

The preferred linkage arrangement would have a dimension of 2.569 inches between the axis of the output shaft and the axis of the drive roller 85 and represented in FIG. 11 by the dimension line 100, a measurement of 3.557 inches between the output shaft axis and the slide bar pivot axis as represented by the dimension line 101, and a measurement of thirteen inches between a horizontal line going through the axis of the slide bar pivot and the rectilinear path of the axis of the door roller 92 as represented by the dimension line 102.

Figure 14:
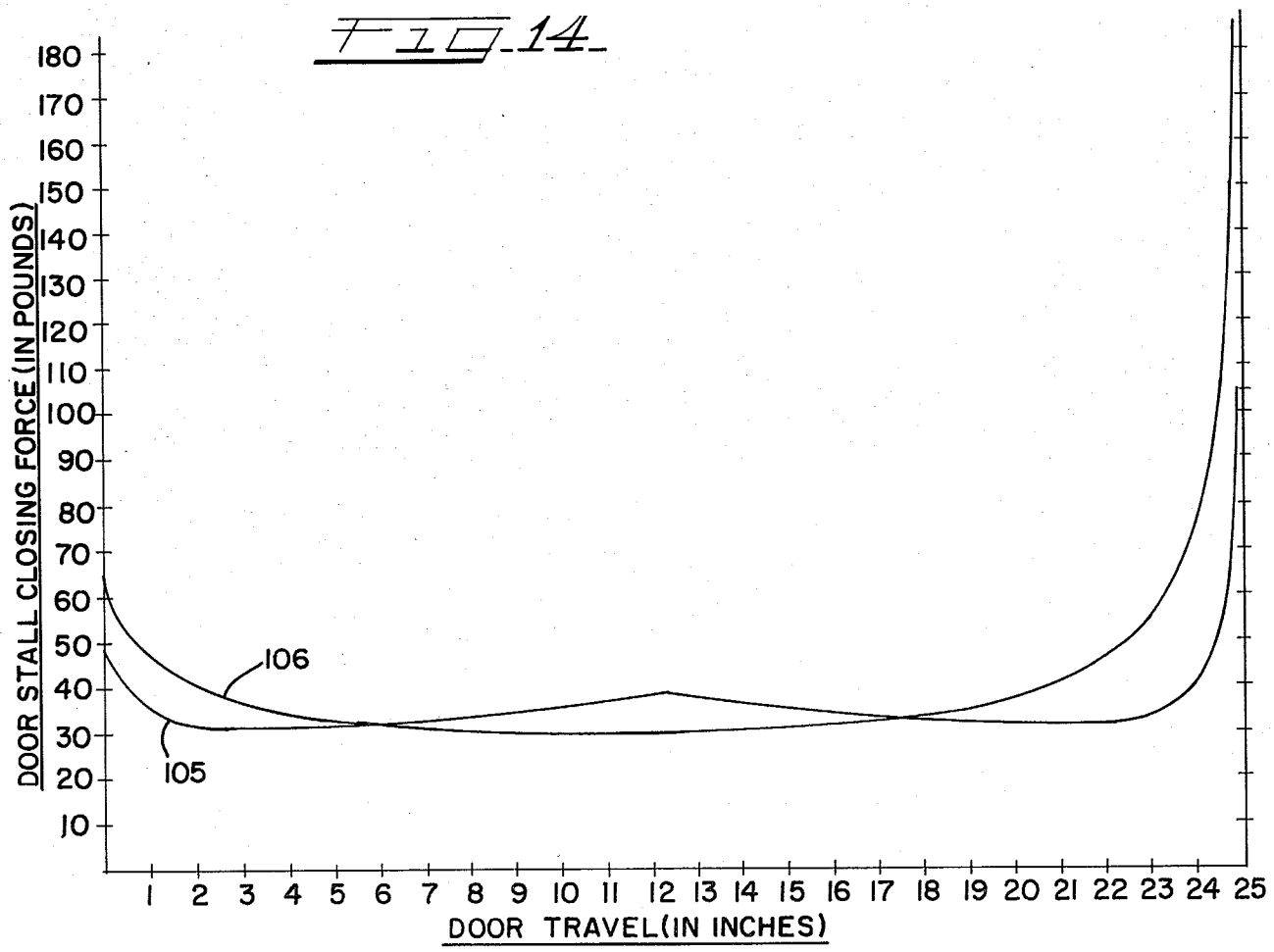
FIG. 14 is a force travel diagram illustrating the curve for a prior art four-bar linkage operator and the curve for the operator of FIG. 11.

In an installation where the door travel is 25 inches, the closing force curve is illustrated at 105 in the force diagram of FIG. 14. This diagram plots door stall closing force in pounds against door travel in inches. The force curve 106 illustrated in FIG. 14 represents the curve of a prior art door operator of the four-bar linkage type with overcenter lock. It can now be appreciated by comparing these curves that the prior art operators produced a large closing force at the end of the closing cycle. More specifically, the closing force of the prior art operators, as illustrated in curve 106, exceeded 45 pounds at three inches prior to close position, while the closing force of the operator according to the present invention was about 32 pounds. It may be appreciated that the closing force is the same as the stall force of the operator and may be easily measured by stalling the operator at the various increments of travel. Within one inch of the closed position of the door operator of the present invention as illustrated by the curve 105, the closing force does not exceed forty pounds. It therefore can be appreciated that the inherent safety of the door operator of the present invention over the known door operators is materially improved.

It will be understood that modifications and variations may be effected without departing from the scope of the novel concepts of the present invention, but it is understood that this application is to be limited only by the scope of the appended claims.

The invention is hereby claimed as follows:

1. In a door operator for driving a door between open and closed positions which operator includes a series wound electric motor driving an output shaft and a linkage arrangement interconnecting the output shaft and the door, the linkage arrangement including a drive arm rotatable with said output shaft, a multiplying lever pivotally mounted at one end, means slidably connecting said door to said multiplying lever and means slidably connecting said drive arm to said multiplying lever, the improvement being in the electric motor having an open circuit saturation curve where at about 50 percent of maximum rated voltage the field current will be about 40 percent of maximum rated and which includes an armature with ten windings of 24-gauge wire and a field of 40 to 80 windings of 26-gauge wire, whereby a substantially constant force is applied to the door by the operator between the open and closed positions.

2. The motor as defined in claim 1, wherein the motor and linkage arrangement are structured such that the door stall closing force for a door traveling about 25 inches between open and closed positions will be in the range of 35–38 pounds over 94 percent of door travel.

3. The door operator as defined in claim 2, which includes a gear box between the motor and the output shaft having a gear ratio in the range of 20 to 25:1.

4. The door operator as defined in claim 3, wherein the door weight is eighty pounds and door movement between open and closed positions is effected in a predetermined time interval.

5. The door operator as defined in claim 4, wherein the time interval is essentially two seconds.

6. The door operator as defined in claim 2, which includes a gear box between the motor and the output shaft having a gear ratio of about 25:1.

7. In a door operator for driving a door between open and closed positions which operator includes a series wound electric motor driving an output shaft and a linkage arrangement interconnecting the output shaft and a linkage arrangement interconnecting the output shaft and the door, the linkage arrangement including means driven by said output shaft, a multiplying lever pivotally mounted at one end, means connecting said door to said multiplying lever and means connecting said output shaft driven means to said multiplying lever, the improvement being in the electric motor having an open circuit saturation curve where at about 50 percent of maximum rated voltage the field current will be about 40 percent of maximum rated and which includes an armature with fifteen windings of 24-gauge wire and a field of 55 to 65 windings of 26-gauge wire, whereby a substantially constant force is applied to the door by the operator between the open and closed positions.

8. In a door operator for driving a door between open and closed positions which operator includes a series wound electric motor driving an output shaft and a linkage arrangement, the improvement in the linkage arrangement which comprises, a drive arm connected to and oscillatable with the output shaft and having a roller mounted adjacent the outer end, and a multiplying lever in the form of a slide bar pivoted at one end on a fixed support and engaging a roller mounted on said door and engaging the roller on said drive bar between said door roller engagement and said pivoted end, and the distance between said output shaft axis and the drive arm roller axis is less than the distance between the pivot axis of said multiplying lever and said output shaft axis, whereby a substantially linear door edge force is produced throughout about 94 percent of door travel.

9. The linkage arrangement defined in claim 8, wherein the pivot axis of the multiplying lever is directly below the output shaft axis.

10. The linkage arrangement defined in claim 9, wherein the distance between the pivot axis of the multiplying lever and the line of travel of the door roller axis is thirteen inches, the distance between said pivot axis and said output shaft axis is 3.557 inches, and the distance between the output shaft axis and the drive arm roller axis is 2.569 inches.

11. The linkage arrangement defined in claim 8, wherein the drive bar moves into an overcenter lock position at the end of the closing cycle.

12. A door operator for driving a door between open and closed positions and maintaining a substantially linear door edge force throughout door travel, which operator comprises a reversible series wound electric motor, a linkage arrangement, and a gear box with a gear ratio of about 25:1 having its input connected to the motor and having an output shaft connected to the linkage arrangement, said motor having an armature with ten windings of 24-gauge wire and a field of forty to eighty windings of 26-gauge wire, and said linkage arrangement having a drive bar connected to and oscillatable with the output shaft and having a roller mounted adjacent the outer end, and a multiplying lever in the form of a slide bar pivotally mounted on one end on an axis parallel to the output shaft axis and engaging adjacent the other end a roller mounted on said door and engaging the roller on said drive bar between the pivot axis and the door roller.

13. The door operator defined in claim 12, wherein means is provided to overcenter lock the drive arm relative to the multiplying lever when the door is in closed position.

14. The door operator defined in claim 13, wherein distance between the pivot axis of the multiplying lever and the line of travel of the door roller axis is thirteen inches, the distance between said pivot axis and said output shaft axis is 3.557 inches, and the distance between the output shaft axis and the drive arm roller axis is 2.569 inches.

15. In a door operator for driving a door between open and closed positions which operator includes a series wound electric motor driving an output shaft and a linkage arrangement interconnecting the output shaft and the door, the linkage arrangement including means driven by said output shaft, a multiplying lever pivotally mounted at one end, and means connecting said door to said multiplying lever and means connecting said output shaft driven means to said multiplying lever, the improvement being in the electric motor which includes an armature with fifteen windings of 24-gauge wire and a field of 55 to 65 windings of 26-gauge wire, and a saturation curve voltage of approximately fifty percent of total at forty percent field current, and approximately 85 percent of total at eighty percent field current, whereby door movement between open and closed positions is effected in a predetermined time interval.

16. The door operator as defined in claim 15 wherein said time interval is essentially two seconds.

17. In a door operator for driving a door between open and closed positions which operator includes an electric motor driving an output shaft and a linkage arrangement, the improvement in the linkage arrangement which comprises; a drive arm connected to and oscillatable with the output shaft and having a slide member pivotally mounted adjacent the outer end, and a multiplying lever in the form of a slide bar pivoted at one end on a fixed support and engaging a slide member pivotally mounted on said door and engaging the slide member on said drive bar between said pivoted end and the door slide member engagement, and the distance between said output shaft axis and the drive arm slide member pivot axis is less than the distance between the pivot axis of said multiplying lever and said output shaft axis, whereby a substantially linear door edge force is produced throughout about 94 percent of door travel.

18. The operator defined in claim 17, wherein the motor uses a permanent magnet design.

19. A door operator for driving a door between open and closed positions and maintaining a substantially linear door edge force throughout door travel, which operator comprises an electric motor, a linkage arrangement, and a gear box having its input connected to the motor and having an output shaft connected to the linkage arrangement, said motor having an armature and an open circuit saturation characteristic such that generated voltage is about fifty percent of maximum at forty percent maximum field current, and approximately 85 percent of maximum at eighty percent maximum field current, and said linkage arrangement having a drive bar connected to and oscillatable with the output shaft and having a roller mounted adjacent the outer end, and a multiplying lever in the form of a slide bar pivotally mounted at one end on an axis spaced from and parallel to the output shaft axis, said lever engaging a roller mounted on said door and the roller on said drive bar between the pivoted end and the engagement with the door roller.

20. The door operator defined in claim 19, wherein means is provided to overcenter lock the drive arm relative to the multiplying lever when the door is in closed position.

21. The operator of claim 20, wherein door operation from open to closed positions is effected in a predetermined time interval.

* * * * *